United States Patent [19]

Strutton et al.

[11] 4,422,188

[45] Dec. 27, 1983

[54] MICTURITION ADAPTOR FOR CONVERSION OF A MALE BED URINAL TO FEMALE USE

[76] Inventors: Bernice M. Strutton, 3344 St. James Pl., Antioch, Calif. 94509; Robert R. Moore, 4010 East Ave., Hayward, Calif. 94542

[21] Appl. No.: 310,919

[22] Filed: Oct. 13, 1981

[51] Int. Cl.[3] ..... A47K 11/00

[52] U.S. Cl. ..... 4/144.4; 4/144.1; 4/114.1

[58] Field of Search ..... 4/144.1, 144.2, 144.3, 4/144.4, 301, 450, 451, 114.1; 128/295

[56] References Cited

U.S. PATENT DOCUMENTS

| | | | |
|---|---|---|---|
| 3,432,865 | 3/1969 | Schwartz | 4/144.3 X |
| 3,473,172 | 10/1969 | Friedman et al. | 4/144.3 |
| 3,963,020 | 6/1976 | Hall | 4/144.3 X |
| 3,964,111 | 6/1976 | Packer | 4/144.4 |
| 4,050,103 | 9/1977 | Nakao et al. | 4/144.3 |
| 4,187,562 | 2/1980 | Mioduski | 4/144.3 |

*Primary Examiner*—Henry K. Artis

*Attorney, Agent, or Firm*—Richard Esty Peterson

[57] ABSTRACT

A female micturition adaptor fabricated from a soft flexible material having a substantially tubular configuration with a first end adapted to connect to an orifice neck of a male urinal and a second slightly enlarged end with an oblique orifice with tipped terminal end contoured to fit against the genital area of a female for allowing a bed confined female to micturate while in a prone or supine position.

7 Claims, 3 Drawing Figures

MICTURITION ADAPTOR FOR CONVERSION OF A MALE BED URINAL TO FEMALE USE

BACKGROUND OF THE INVENTION

This invention relates to an adaptor device for converting a conventional male bed urinal to female use by connecting the adaptor to the opening of a urinal container. The adaptor is fabricated from a soft, flexible, water impervious material with a contoured opening designed for placement against a female's genital area. The adaptor device is designed to permit a female user confined to a bed to micturate in a prone or supine position.

While the male urinal container has been devised for the convenience of bedridden men, allowing urination without difficulty or discomfort, no equivalent device has been devised for women that can be used while a woman remains in a comfortable supine position. Such restricted positioning is often required after back or hip surgery. Conventionally, a convalescing woman must either leave her bed to visit a commode or use a bed pan which requires often a substantial and intolerable effort to raise the hips for positioning over a bed pan. While in extreme cases a woman may require catherization, this is an uncomfortable and painful experience. The need for a device that is as convenient to use as a male bed urinal, which is simply a pitcher-like container with a suitable size opening, is apparent.

It is particularly desirable to have available a device to permit a female to urinate under hygenic conditions without having to move from a supine position. Because many post-surgery conditions require minimized movement, even the process of elevating the buttock for use of a bed pan, can be dangerous as well as painful. Where use of a bed pan is simply an inconvenience and a discomfort, the experience can nevertheless be psychologically disagreeable to both the patient and attendant. Occasionally such use can result in spillage and unhygenic conditions.

It is a primary object of this invention to provide an inexpensive device that can be adapted to conventional hospital equipment, but can be discarded to maintain strict hygenic conditions.

SUMMARY OF THE INVENTION

A female micturition adaptor for connection to a male designed bed urinal for converting the urinal to female use. The adaptor is fabricated of a soft flexible material molded in a generally cylindrical or slightly conical, tubular configuration with a first end constructed to connect to the container orifice of a conventional male urinal. The molded adaptor has a second slightly enlarged end with a substantially oblique cross sectional orifice with an inwardly tipped terminal lip. The orifice is designed for comfortable placement against the genital area, circumventing the labia, for convenient micturition of bedridden or convalescing females.

While designed, in particular, for use by a woman in a prone or supine position, the micturition adaptor can be utilized for a woman who is in an elevated sitting position in bed or while standing or squatting, for example, when collecting a urine sample. These and other features of the invention will become apparent from a detailed consideration of the preferred embodiment.

DETAILED DESCRIPTION OF THE PREFERRED EMBODIMENT

Figure 1:
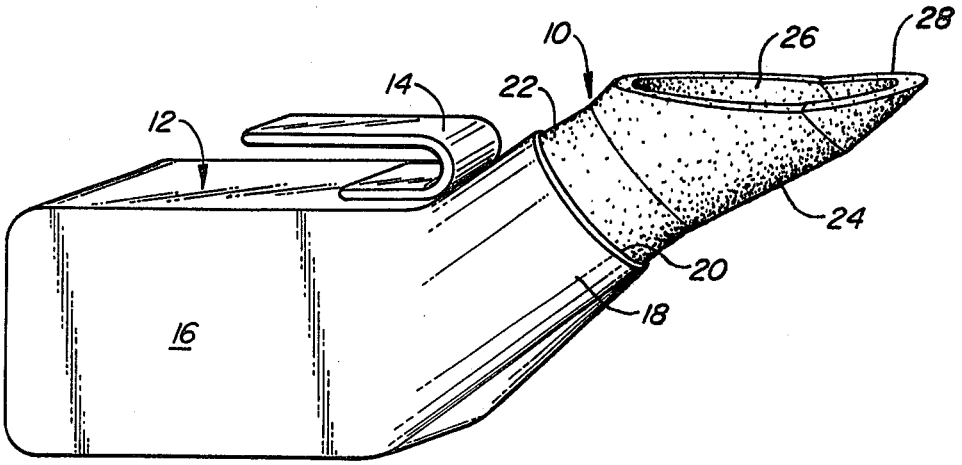
FIG. 1 is a perspective view of the micturition adaptor connected to a male urinal.

Referring to FIG. 1 the preferred configuration of the micturition adaptor, designed generally by the reference numeral 10, is shown connected to a conventional male urinal 12. While the male urinal 12 comprises a convenient collection container for bedridden male patients, particularly in hospital settings, it is not readily useable for female patients, who must utilize the awkward bed pan. The male urinal 12 customarily includes a handle 14, a container body 16 and a neck 18 with a circular orifice 20. The orifice 20 is approximately two and one half inches in diameter for convenient use. The body of the urinal may vary from the contoured body of the urinal shown, and may be simply cylindrical in configuration.

The micturition adaptor 10 is fabricated from a polyurethane material with a treated surface to provide a soft, flexible device with a smooth substantially impervious surface. Other similar plastic or polymer compositions may be used to achieve the flexibility and softness necessary for comfortable seating of the adaptor against leakage or spillage.

Figure 2:
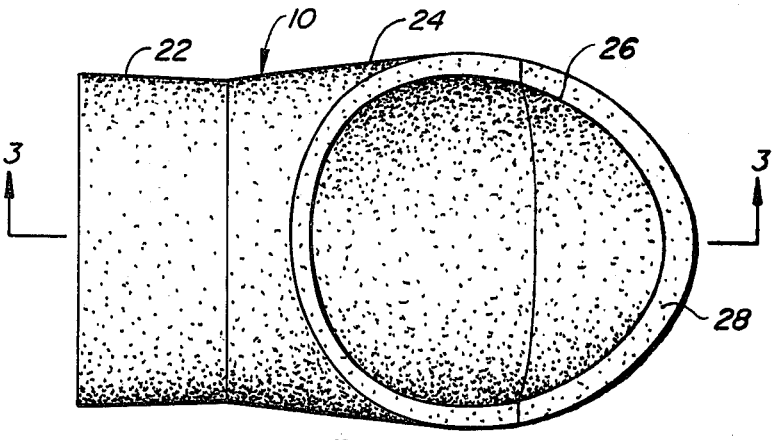
FIG. 2 is a top view of the adaptor of FIG. 1.
Figure 3:
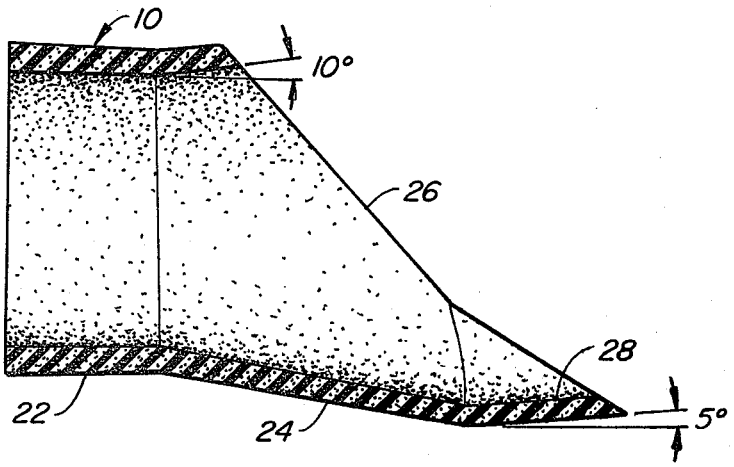
FIG. 3 is a side, cross-sectional view taken on the lines 3—3 of FIG. 2.

One end 22 of the adaptor 10 is generally cylindrical in configuration and fits into the neck 18 of the male urinal 12 in a sleeve-like manner. The opposite end 24 is slightly enlarged with a substantially oblique cross sectional orifice 26 as shown in FIGS. 2 and 3. The orifice 26 terminates in an inwardly tipped lip 28. The configuration enables placement of the orifice 26 against the genital area of the female user with the circumferential orifice 26 encircling the outside of the labia with the tipped lip 28 pressed and deformed against the perineum, while the user is in a prone position with her thighs comfortably spread. If possible it is preferred that the thighs be partially elevated by slightly bending legs at the knees causing a slight tip to the pelvis. Upon completion of urination, the deformed lip 28 reassumes its slightly raised position as the urinal and adaptor are removed from the pressed placements against the vaginal area. This inhibits any inadvertent runout or drip during withdrawal of the urinal and adaptor.

The preferred contour of the adaptor is shown in the cross-sectional view of FIG. 3. As shown, the wall thickness of the first end 22 is slightly enlarged at the opening to insure a firm grip and seal when installed into the neck of the urinal. The configuration and size of the first end of the adaptor is not critical to the invention and is constructed to conform the particular type of male urinal to which it is attached and may vary in construction to be easily connectable to urinals of different style and design. For example, the first end may be constructed to fit over the neck of the urinal or may be constructed with threaded-like grooves to screw onto or into a compatibly threaded neck of a urinal having such design. From the first end portion the adaptor bells at a 10 degree angle. The orifice 26 at the second end 24 is formed by an oblique cross section starting at a 40 degree angle and graduating to a 60 degree angle at the terminal lip 28. The outer portion of the lip is adjusted from the outward 10 degree bell to a 5 degree inward slope to achieve the upward tip of the lip.

The preferred contour described provides a relatively basic fit that is somewhat adjustable by deformation of the relatively soft material when pressed against the genital area in a circumventing fashion around the labia and urethrea. Because of the inexpensive molding process in fabricating the adaptors, the adaptor is discardable after use.

While in the foregoing specification embodiments of the invention have been set forth in considerable detail for the purposes of making a complete disclosure of the invention, it should be apparent to those or ordinary skill in the art that numerous changes may be made in such details without departing from the spirit and principles of the invention.

What is claimed is:

1. A micturition adaptor for converting to female use a conventional male bed urinal having a container portion and a neck portion with a circular orifice, the adaptor comprising: a molded member fabricated from a soft, flexible material of tubular configuration with a first orifice end of circular cross section constructed to connect to the neck portion of the male urinal and a second end having a substantially oblique cross-sectional orifice with an inwardly tipped deformable terminal lip, said second end being contoured for placement against the genital area of a female in a substantially sealing manner during micturition, wherein said tipped lip is pressed and deformed against the user's perineum while the user is in a prone position with her thighs comfortably spread said deformed lip reassuming a slightly raised position as the urinal and said adaptor are removed from the pressed placement against the user's vaginal area to inhibit inadvertent runout or drip during withdrawal of the urinal and said adaptor.

2. The adaptor of claim 1 wherein said molded member is slightly conical in configuration with an enlarged second end.

3. The adaptor of claim 1 wherein said member is fabricated from a polyurethane material.

4. The adaptor of claim 1 wherein said first orifice end is installable into the neck portion of the male urinal.

5. The adapter of claim 1 wherein said first orifice end has a slightly enlarged wall thickness to insure sealing.

6. The micturition adaptor of claim 2 wherein said enlarged second end has approximately an outward 10 degree bell with an end having approximately an inward 5 degree slope wherein in use an upward tipped terminal lip is provided.

7. The micturation adaptor of claim 6 wherein said substantially oblique cross-sectional orifice has approximately an oblique cross-section starting at a 40 degree angle and graduating to approximately a 60 degree angle.

* * * * *